US007255893B2

(12) United States Patent
Nguyen et al.

(10) Patent No.: US 7,255,893 B2
(45) Date of Patent: Aug. 14, 2007

(54) PROTECTION OF NON-CARBON ANODES AND OTHER OXIDATION RESISTANT COMPONENTS WITH IRON OXIDE-CONTAINING COATINGS

(75) Inventors: Thinh T. Nguyen, Onex (CH); Vittorio De Nora, Nassau (BS)

(73) Assignee: Moltech Invent S.A., Luxembourg (LU)

( * ) Notice: Subject to any disclaimer, the term of this patent is extended or adjusted under 35 U.S.C. 154(b) by 338 days.

(21) Appl. No.: 10/526,913

(22) PCT Filed: Sep. 9, 2003

(86) PCT No.: PCT/IB03/03978

§ 371 (c)(1),
(2), (4) Date: Mar. 7, 2005

(87) PCT Pub. No.: WO2004/024994

PCT Pub. Date: May 25, 2004

(65) Prior Publication Data

US 2006/0011490 A1 Jan. 19, 2006

(30) Foreign Application Priority Data

Sep. 11, 2002 (WO) ..... IB02/03759

(51) Int. Cl.
*B05D 5/12* (2006.01)

(52) U.S. Cl. ..... 427/126.6; 427/58; 427/77; 427/126.1; 427/126.3; 427/189; 427/190; 427/205; 427/331; 427/375; 427/376.2; 427/376.3; 427/383.5; 205/372; 205/384; 205/385; 205/387; 204/243.1; 204/290.1; 204/290.12; 204/291

(58) Field of Classification Search ..... 427/126.6, 427/126.1, 126.3, 58, 77, 189, 190, 205, 427/331, 375, 376.2, 376.3, 383.5; 205/372, 205/384, 385, 387; 204/243.1, 290.01, 290.1, 204/290.12, 291

See application file for complete search history.

(56) References Cited

U.S. PATENT DOCUMENTS 4,039,401 A * 8/1977 Yamada et al. ..... 205/384
4,173,518 A * 11/1979 Yamada et al. ..... 205/384
4,374,050 A * 2/1983 Ray ..... 252/516
4,374,761 A * 2/1983 Ray ..... 252/512
4,956,069 A * 9/1990 Salazar ..... 204/257
4,960,494 A * 10/1990 Nguyen et al. ..... 205/384
5,069,771 A * 12/1991 Nguyen et al. ..... 204/292
5,310,476 A * 5/1994 Sekhar et al. ..... 205/230
5,340,448 A * 8/1994 Sekhar et al. ..... 205/379
5,364,513 A * 11/1994 Sekhar et al. ..... 204/290.02
5,527,442 A * 6/1996 Sekhar et al. ..... 204/247.3
5,651,874 A * 7/1997 de Nora et al. ..... 205/372
6,001,236 A * 12/1999 de Nora et al. ..... 205/230
6,077,415 A * 6/2000 Duruz et al. ..... 205/384
6,103,090 A * 8/2000 de Nora et al. ..... 205/384
6,113,758 A * 9/2000 de Nora et al. ..... 204/284
6,248,227 B1 * 6/2001 de Nora et al. ..... 205/230
6,287,447 B1 * 9/2001 de Nora et al. ..... 205/378
6,372,119 B1 * 4/2002 Ray et al. ..... 205/387
2006/0003084 A1 * 1/2006 Nguyen ..... 427/58

* cited by examiner

*Primary Examiner*—Bruce F. Bell
(74) *Attorney, Agent, or Firm*—Jayadeep R Deshmukh

(57) ABSTRACT

A method of forming a dense and crack-free hematite-containing protective layer on a metal-based substrate for use in a high temperature oxidising and/or corrosive environment comprises applying onto the substrate a particle mixture consisting of: 60 to 99 95 weight %, in particular 70 to 95 weight % such as 75 to 85 weight %, of hematite with or without iron metal and/or ferrous oxide; 1 to 25 weight %, in particular 5 8 to 20 weight % such as 8 to 15 weight %, of nitride and/or carbide particles, such as boron nitride, aluminium nitride or zirconium carbide particles; and 0 to 15 weight %, in particular 5 to 15 weight %, of one or more further constituents that consist of at least one metal or metal oxide or a heat-convertible precursor thereof. The hematite particles are then sintered by heat treating the particle mixture to form the protective layer that is made of a microporous sintered hematite matrix in which the nitride and/or carbide particles are embedded and which contains, when present, said one or more further constituents. The mechanical, electrical and electrochemical properties of the protective layer can be improved by using an oxide of titanium, zinc, zirconium or copper. Typically, the protected substrate can be used in a cell for the electrowinning of a metal such as aluminium.

32 Claims, No Drawings

PROTECTION OF NON-CARBON ANODES AND OTHER OXIDATION RESISTANT COMPONENTS WITH IRON OXIDE-CONTAINING COATINGS

FIELD OF THE INVENTION

This invention relates to a method of manufacturing non-carbon anodes for use in aluminium electrowinning cells as well as other oxidation resistant components.

BACKGROUND ART

Using non-carbon anodes—i.e. anodes which are not made of carbon as such, e.g. graphite, coke, etc . . . , but possibly contain carbon in a compound—for the electrowinning of aluminium should drastically improve the aluminium production process by reducing pollution and the cost of aluminium production. Many attempts have been made to use oxide anodes, cermet anodes and metal-based anodes for aluminium production, however they were never adopted by the aluminium industry.

For the dissolution of the raw material, usually alumina, a highly aggressive fluoride-based electrolyte, such as cryolite, is required.

Materials for protecting aluminium electrowinning components have been disclosed in U.S. Pat. Nos. 5,310,476, 5,340,448, 5,364,513, 5,527,442, 5,651,874, 6,001,236, 6,287,447 and in PCT publication WO01/42531 (all assigned to MOLTECH). Such materials are predominantly made (more that 50%) of non-oxide ceramic materials, e.g. borides, carbides or nitrides, and are suitable for exposure to molten aluminium and to a molten fluoride-based electrolyte. However, these non-oxide ceramic-based materials do not resist exposure to anodically produced nascent oxygen.

The materials having the greatest resistance to oxidation are metal oxides which are all to some extent soluble in cryolite. Oxides are also poorly electrically conductive, therefore, to avoid substantial ohmic losses and high cell voltages, the use of oxides should be minimal in the manufacture of anodes. Whenever possible, a good conductive material should be utilised for the anode core, whereas the surface of the anode is preferably made of an oxide having a high electrocatalytic activity.

Several patents disclose the use of an electrically conductive metal anode core with an oxide-based active outer part, in particular U.S. Pat. Nos. 4,956,069, 4,960,494, 5,069,771 (all Nguyen/Lazouni/Doan), 6,077,415 (Duruz/de Nora), 6,103,090 (de Nora), 6,113,758 (de Nora/Duruz) and 6,248,227 (de Nora/Duruz), as well as PCT publications WO00/06803 (Duruz/de Nora/Crottaz), WO00/06804 (Crottaz/Duruz), WO00/40783 (de Nora/Duruz), WO01/42534 (de Nora/Duruz) and WO01/42536 (Nguyen/Duruz/ de Nora).

U.S. Pat. Nos. 4,039,401 and 4,173,518 (both Yamada/Hashimoto/Horinouchi) disclose multiple oxides for use as electrochemically active anode material for aluminium electrowinning. The multiple oxides include inter-alia oxides of iron, nickel, titanium and yttrium, such as $NiFe_2O_4$ or $TiFe_2O_4$, in U.S. Pat. No. 4,039,401, and oxides of yttrium, iron, titanium and tantalum, such as $Fe_2O_3.Ta_2O_5$, in U.S. Pat. No. 4,173,518. The multiple oxides are produced by sintering their constitutive single oxides and then they are crushed and applied onto a metal substrate (titanium, nickel or copper) by spraying or dipping. Alternatively, the multiple oxides can be produced by electroplating onto the metal substrate the constitutive metals of the multiple oxides followed by an oxidation treatment.

Likewise U.S. Pat. Nos. 4,374,050 and 4,374,761 (both Ray) disclose non-stoichiometric multiple oxides for use as electrochemically active anode material for aluminium electrowinning. The multiple oxides include inter-alia oxides of nickel, titanium, tantalum, yttrium and iron, in particular nickel-iron oxides. The multiple oxides are produced by sintering their constitutive single oxides and then they can be cladded onto a metal substrate.

WO99/36591 (de Nora), WO99/36593 and WO99/36594 (both Duruz/de Nora) disclose sintered multiple oxide coatings applied onto a metal substrate from a slurry containing particulate of the multiple oxides in a colloidal and/or inorganic polymeric binder, in particular colloidal or polymeric alumina, ceria, lithia, magnesia, silica, thoria, yttria, zirconia, tin oxide or zinc oxide. The multiple oxides include ferrites of cobalt, copper, chromium, manganese, nickel and zinc. It is mentioned that the coating can be obtained by reacting precursors thereof among themselves or with constituents of the substrate.

U.S. Pat. No. 6,372,119 and WO01/31091 (both Ray/Liu/Weirauch) disclose a cermet made from sintered particles of nickel, iron and cobalt oxides and of metallic copper and silver possibly alloyed with cobalt, nickel, iron, aluminium, tin, niobium, tantalum, chromium molybdenum or tungsten. The particles can be applied as a coating onto an anode substrate and sintered thereon to form an anode for the electrowinning of aluminium.

These non-carbon anodes have not as yet been commercially and industrially applied and there is still a need for metal-based anodes for aluminium production.

SUMMARY OF THE INVENTION

The present invention relates primarily to a method of forming a hematite-containing protective layer on a metal-based substrate for use in a high temperature oxidising and/or corrosive environment. The method comprises the following steps (I) and (II):

Step (I) of the method includes applying onto the substrate a particle mixture that comprises: hematite ($Fe_2O_3$) with or without iron metal (Fe) and/or ferrous oxide (FeO); nitride and/or carbide particles; and optionally one or more further constituents.

This hematite ($Fe_2O_3$) and optional iron metal (Fe) and/or ferrous oxide (FeO) is/are present in a total amount of 60 to 99 weight % of the particle mixture, in particular 70 to 95 weight % such as 75 to 85 weight %.

When the particle mixture contains hematite ($Fe_2O_3$) and iron metal (Fe), the weight ratio $Fe/Fe_2O_3$ is preferably no more than 2, in particular in the range from 0.6 to 1.3. When the particle mixture contains hematite ($Fe_2O_3$) and ferrous oxide (FeO), the weight ratio $FeO/Fe_2O_3$ is preferably no more than 2.5, in particular in the range from 0.7 to 1.7. When the particle mixture contains hematite ($Fe_2O_3$), iron metal (Fe) and ferrous oxide (FeO), the weight ratios $Fe/Fe_2O_3$ and $FeO/Fe_2O_3$ are in pro rata with the above ratios.

Iron metal will usually be provided in the form of iron metal particles and/or possibly surface oxidised iron metal particles. Ferrous oxide and hematite can be provided in the form of ferrous oxide particles and hematite particles respectively, and/or in the form of magnetite ($Fe_3O_4$=$FeO.Fe_2O_3$) particles.

The nitride and/or carbide particles are present in a total amount of 1 to 25 weight % of the particle mixture, in particular 5 to 20 weight % such as 8 to 15 weight %. The nitride and/or carbide particles may comprise boron nitride, aluminium nitride, silicon nitride, silicon carbide, tungsten carbide or zirconium carbide particles.

Said one or more further constituents can be present in a total amount of up to 15 weight %, in particular 5 to 15 weight %. Such one or more further constituents consist of at least one metal or metal oxide or a heat-convertible precursor thereof.

These further constituents, when present, may be provided in the form of separate particles or particles of a mixture of the further constituent(s) with hematite ($Fe_2O_3$) and/or optionally with iron metal (Fe) and/or ferrous oxide (FeO). For example particles of an alloy of iron and one or more further constituents, e.g. nickel or titanium, may be added to the particle mixture. Moreover, it is likely to find such further constituents on the surface of the nitride and/or carbide particles, in particular as an oxide such as alumina or zirconia, of a metal constituent of the nitride and/or carbide.

Step (II) of the method comprises consolidating the hematite by heat treating the particle mixture so as to: oxidise iron metal (Fe) when present into ferrous oxide (FeO); sinter the hematite ($Fe_2O_3$) to form a porous sintered hematite matrix; and oxidise the ferrous oxide (FeO), when present in the particle mixture as such and/or upon oxidation of the iron metal (Fe), into hematite ($Fe_2O_3$) so as to fill the sintered hematite matrix.

The protective layer formed by this consolidation is made of a microporous sintered hematite matrix in which the nitride and/or carbide particles are embedded and which optionally contains said one or more further constituents.

When hematite particles are sintered among themselves by heat treatment, they undergo a volume contraction which results in the formation of cracks.

However, it has been observed that the addition of minor amounts of carbide and/or nitride particles to the hematite particles inhibits the formation of such cracks during sintering.

Without being bound to any theory, it is believed that these carbide/nitride particles are chemically substantially inert during the sintering process. However, their presence physically inhibits aggregation of the voids formed by the sintering contraction of the hematite-based material. Thus, instead of forming compact portions of hematite separated by cracks formed by aggregation of voids, the sintering process with the carbide/nitride particles produces a continuous crack-free hematite-based material having throughout a homogeneous microporosity. This microporosity results from the local sintering contraction of the hematite which forms micropores that are inhibited from significantly migrating in the hematite-based material by the presence of the carbide/nitride particles that act as barriers against significant pore migration.

Nitrides and carbides being less resistant to oxidation than hematite and also less resistant than hematite to dissolution in an aggressive environment such as a fluoride-based molten electrolyte, the amount of nitride/carbide particles in the particle mixture is preferably maintained at a low value, e.g. below 20 or even below 15 weight %. However, when the protective layer is exposed to conditions that are less severe than when it is used as an active anode coating for aluminium production, the protective layer can contain up to 25 weight % nitride/carbide particles.

The use in combination with hematite ($Fe_2O_3$) of iron metal (Fe) and/or ferrous oxide (FeO) which expand in volume when oxidised, reduces the contraction-resulting cracks of hematite during sintering. In other words, the formation of hematite from the ferrous oxide results in a volume expansion that fills the porous sintered hematite matrix and inhibits formation of cracks by contraction of the pores of the hematite matrix during sintering.

Further details relating to the use of iron metal and ferrous oxide to avoid the formation of cracks in a sintered hematite coating are disclosed in PCT/IB03/03654 (Nguyen/de Nora).

When the particle mixture contains neither iron metal nor ferrous oxide that would inhibit the crack formation, it should contain at least 5 weight %, preferably at least 8 weight %, nitride and/or carbide particles to inhibit void aggregation in the coating. Conversely, when the particle mixture contains a noticeable proportion of iron metal or ferrous oxide, e.g. a ratio $Fe/Fe_2O_3$ above 0.6 or a ratio $FeO/Fe_2O_3$ above 0.7, the particle mixture can contain only a relatively small amount of nitride and/or carbide particles, i.e. even below 5 weight %.

The method according to the invention thus provides a hematite-containing protective layer that is dense and substantially crack-free and that inhibits diffusion from and to the metal-based substrate, in particular it prevents diffusion of constituents, such as nickel, from the substrate.

The electrical/electrochemical properties of the protective layer can be improved by selecting at least one of the further constituents from oxides of titanium, yttrium, ytterbium, tantalum, manganese, zinc, zirconium, cerium and nickel and/or a heat-convertible precursor thereof. Such selected further constituents can be present in the protective layer in a total amount of 1 to 15 weight %. Usually, it is sufficient for these selected further constituents to be present in a catalytic amount to achieve the electrical/electrochemical effect, in particular in a total amount of 5 to 12 weight %.

The protective layer can alternatively or additionally comprise at least one of the further constituents selected from metallic Cu, Ag, Pd, Pt, Co, Cr, Al, Ga, Ge, Hf, In, Ir, Mo, Mn, Nb, Re, Rh, Ru, Se, Si, Sn, Ti, V, W, Li, Ca, Ce and Nb and/or an oxide thereof which can be added to the particle mixture as such or as a precursor, in the form of particles or in solution, for example a salt such as a chloride, sulfate, nitrate, chlorate or perchlorate, or a metal organic compound such as an alkoxide, formate or acetate. These selected further constituents can be present in the protective layer in a total amount of 0.5 to 15 weight %, preferably from 0.5 to 5 weight %, in particular from 1 to 3 weight %.

Minor amounts of copper or copper oxides, i.e. up to 3 or 5 weight %, improve the electrical conductivity of the protective layer and diffusion of iron oxide (and possibly other oxides) during the sintering of the protective layer. This leads to the production of more conductive and denser protective layers than without the use of copper metal and/or oxides.

Limiting the amount of further constituents also reduces the risk of contamination of the protective layer's environment during use, e.g. an electrolyte of a metal electrowinning cell.

The particle mixture can be made of particles that are smaller than 75 micron, preferably smaller than 50 micron, in particular from 5 to 45 micron.

The substrate can be metallic, ceramic, a cermet of a surface-oxidised metal.

Usually, the substrate comprises at least one metal selected from chromium, cobalt, hafnium, iron, molybdenum, nickel, copper, niobium, platinum, silicon, tantalum, titanium, tungsten, vanadium, yttrium and zirconium or an oxide thereof. For instance, the substrate comprises an alloy of iron, in particular an iron-nickel alloy optionally containing at least one further element selected from cobalt, copper, aluminium, yttrium, manganese, silicon and carbon.

Advantageously, the method of the invention comprises oxidising the surface of a metallic substrate to form an integral anchorage layer thereon to which the protective layer is bonded by sintering during heat treatment, in particular an integral layer containing an oxide of iron and/or another metal, such as nickel, that is sintered during the heat treatment with iron oxide from the particle mixture. Further details on such an anchoring of the protective layer are disclosed in PCT/IB03/01479 (Nguyen/de Nora).

When used for aluminium electrowinning, the protected metal-based substrate preferably contains at least one metal selected from nickel, iron, cobalt, copper, aluminium and yttrium. Suitable alloys for such a metal-based substrate are disclosed in U.S. Pat. No. 6,372,099 (Duruz/de Nora), and WO00/06803 (Duruz/de Nora/Crottaz), WO00/06804 (Crottaz/Duruz), WO01/42534 (de Nora/Duruz), WO01/42536 (Duruz/Nguyen/de Nora), WO02/083991 (Nguyen/de Nora), WO03/014420 (Nguyen/Duruz/de Nora) and PCT/IB03/00964 (Nguyen/de Nora).

The particle mixture can be applied onto the substrate in a slurry. Such a slurry may comprise an organic binder which is at least partly volatilised during sintering, in particular a binder selected from polyvinyl alcohol, polyvinyl acetate, polyacrylic acid, hydroxy propyl methyl cellulose, polyethylene glycol, ethylene glycol, hexanol, butyl benzyl phthalate and ammonium polymethacrylate. The slurry may also comprise an inorganic binder, in particular a colloid, such as a colloid selected from lithia, beryllium oxide, magnesia, alumina, silica, titania, vanadium oxide, chromium oxide, manganese oxide, iron oxide, gallium oxide, yttria, zirconia, niobium oxide, molybdenum oxide, ruthenia, indium oxide, tin oxide, tantalum oxide, tungsten oxide, thallium oxide, ceria, hafnia and thoria, and precursors thereof such as hydroxides, nitrates, acetates and formates thereof, all in the form of colloids; and/or an inorganic polymer, such as a polymer selected from lithia, beryllium oxide, alumina, silica, titania, chromium oxide, iron oxide, nickel oxide, gallium oxide, zirconia, niobium oxide, ruthenia, indium oxide, tin oxide, hafnia, tantalum oxide, ceria and thoria, and precursors thereof such as hydroxides, nitrates, acetates and formates thereof, all in the form of inorganic polymers. Such an inorganic binder may be sintered during the heat treatment with an oxide of an anchorage layer which is integral with the metal-based substrate to bind the protective layer to the metal-based substrate.

Typically, the particle mixture is consolidated on the substrate by heat treatment at a temperature in the range from 800° to 1400° C., in particular from 850° to 1150° C. The particle mixture can be consolidated on the substrate by heat treatment for 1 to 48 hours, in particular for 5 to 24 hours. Usually, the particle mixture is consolidated on the substrate by heat treatment in an atmosphere containing 10 to 100 mol % $O_2$.

Further details on the application of inorganic colloidal and/or polymeric slurries on metal substrates are disclosed in U.S. Pat. Nos. 6,361,681 (de Nora/Duruz) and U.S. Pat. No. 6,365,018 (de Nora) and in PCT/IB02/01239 (Nguyen/de Nora).

Typically, the component of the invention is a component of a cell for the electrowinning of a metal such as aluminium, in particular a current carrying anodic component such as an active anode structure or an anode stem. The protective layer can be used not only to protect the current carrying component but also to form the electrochemically active part of the anodic component. Alternatively, the component of the invention may be another cell component exposed to molten electrolyte and/or cell fumes, such as a cell cover or a powder feeder. Examples of such cell components are disclosed in WO00/40781 and WO00/40782 (both de Nora), WO00/63464 (de Nora/Berclaz), WO01/31088 (de Nora) and WO02/070784 (de Nora/Berclaz). The applied layers on such cell components can be consolidated before use by heat treating the components over a cell.

Advantageously, the particle mixture can be consolidated by heat treating the cell component over the cell to form the protective layer. By carrying out the consolidation heat-treatment immediately before use, thermal shocks and stress caused by cooling and re-heating of the component between consolidation and use can be avoided.

Another aspect of the invention relates to a method of electrowinning a metal such as aluminium. The method comprises manufacturing by the above described method a current-carrying anodic component protected by a protective layer, installing the anodic component in a molten electrolyte containing a dissolved salt of the metal to electrowin, such as alumina, and passing an electrolysis current from the anodic component to a facing cathode in the molten electrolyte to evolve oxygen anodically and produce the metal cathodically.

The electrolyte can be a fluoride-based molten electrolyte, in particular containing fluorides of aluminium and sodium. Further details of suitable electrolyte compositions are for example disclosed in WO02/097167 (Nguyen/de Nora).

The cell can be operated with an electrolyte maintained at a temperature in the range from 800° to 960° C., in particular from 880° to 940° C.

Preferably, to reduce the solubility of metal-based cell components, an alumina concentration which is at or close to saturation is maintained in the electrolyte, particularly adjacent the anodic component.

An amount of iron species can also be maintained in the electrolyte to inhibit dissolution of the protective layer of the anodic component. Further details on such a cell operation are disclosed in the above mentioned U.S. Pat. No. 6,372,099.

The invention relates also to method of electrowinning a metal such as aluminium. The method comprises manufacturing by the above disclosed method a cover protected by a protective layer, placing the cover over a metal production cell trough containing a molten electrolyte in which a salt of the metal to electrowin is dissolved, passing an electrolysis current in the molten electrolyte to evolve oxygen anodically and metal cathodically, and confining electrolyte vapours and evolved oxygen within the cell trough by means of the protective layer of the cover.

Further features of cell covers are disclosed in U.S. Pat. No. 6,402,928 (de Nora/Sekhar), WO/070784 (de Nora/Berclaz) and PCT/IB03/02360 (de Nora/Berclaz).

A further aspect of the invention relates to a hematite-containing protective layer on a metal-based substrate for use in a high temperature oxidising and/or corrosive environment. The protective layer on the substrate is producible by the above described method.

Yet a further aspect of the invention concerns a cell for the electrowinning of a metal, such as aluminium, having at least one component that comprises a metal-based substrate covered with a hematite-containing protective layer as defined above.

In a modification of the invention, the above hematite-containing mixture can be shaped into a body and consolidated by sintering as discussed above.

DETAILED DESCRIPTION

Examples of starting compositions of particle mixtures for producing protective layers according to the invention are given in Table 1, which shows the weight percentages of the indicated constituents for each specimen A1-Q1. Examples of alloy compositions of substrates for application of protective layers according to the invention are given in Table 2, which shows the weight percentages of the indicated metals for each specimen A2-O2.

TABLE 1

| | $Fe_2O_3$ | Fe | FeO | BN | AlN | ZrC | $TiO_2$ | $ZrO_2$ | ZnO | $Ta_2O_5$ | CuO |
|---|---|---|---|---|---|---|---|---|---|---|---|
| A1 | 78 | — | — | 10 | — | — | 10 | — | — | — | 2 |
| B1 | 78 | — | — | 10 | — | — | — | — | 10 | — | 2 |
| C1 | 70 | — | — | 18 | — | — | — | — | 10 | — | 2 |
| D1 | 78 | — | — | 10 | — | — | — | 10 | — | — | 2 |
| E1 | 80 | — | — | 10 | — | — | — | — | — | — | 10 |
| F1 | 78 | — | — | 10 | — | — | — | — | — | 10 | 2 |
| G1 | 78 | — | — | — | 10 | — | 10 | — | — | — | 2 |
| H1 | 78 | — | — | — | 12 | — | — | — | 5 | 3 | 2 |
| I1 | 70 | — | — | 10 | 4 | 3 | — | 2 | 5.5 | 3 | 2.5 |
| J1 | 75 | — | — | 14 | — | — | 5 | 5 | — | — | 1 |
| K1 | 85 | — | — | 5 | 4 | — | — | — | 6 | — | — |
| L1 | 75 | — | — | — | — | 12 | 5 | — | — | 5 | 3 |
| M1 | 48 | 25 | 10 | 5 | — | — | 10 | — | — | — | 2 |
| N1 | 34 | 20 | 30 | 2 | — | — | 10 | — | — | — | 4 |
| O1 | 48 | 35 | — | — | 10 | — | — | — | 5 | — | 2 |
| P1 | 40 | — | 40 | 3 | 3 | — | 9 | — | — | — | 5 |
| Q1 | 42 | 20 | 20 | 4 | — | — | 12 | — | — | — | 2 |

TABLE 2

| | Ni | Fe | Co | Cu | Al | Y | Mn | Si | C |
|---|---|---|---|---|---|---|---|---|---|
| A2 | 48 | 38 | — | 10 | 3 | — | 0.5 | 0.45 | 0.05 |
| B2 | 49 | 40 | — | 7 | 3 | — | 0.5 | 0.45 | 0.05 |
| C2 | 36 | 50 | — | 10 | 3 | — | 0.5 | 0.45 | 0.05 |
| D2 | 36 | 50 | — | 10 | 3 | 0.35 | 0.3 | 0.3 | 0.05 |
| E2 | 36 | 53 | — | 7 | 3 | — | 0.5 | 0.45 | 0.05 |
| F2 | 36 | 53 | — | 7 | 3 | 0.35 | 0.3 | 0.3 | 0.05 |
| G2 | 48 | 38 | — | 10 | 3 | 0.35 | 0.3 | 0.3 | 0.05 |
| H2 | 22 | 68 | — | 5.5 | 4 | — | 0.25 | 0.2 | 0.05 |
| I2 | 42 | 42 | — | 12 | 2 | 1 | 0.5 | 0.45 | 0.05 |
| J2 | 42 | 40 | — | 12.5 | 4 | 0.4 | 0.45 | 0.6 | 0.05 |
| K2 | 45 | 44 | — | 7 | 3 | — | 0.5 | 0.45 | 0.05 |
| L2 | 30 | 69 | — | — | — | — | 0.5 | 0.45 | 0.05 |
| M2 | 25 | 65 | 7 | 1 | 1 | — | 0.5 | 0.45 | 0.05 |
| N2 | 55 | 32 | — | 10 | 2 | 0.2 | 0.3 | 0.45 | 0.05 |
| O2 | 55 | 32 | — | 10 | 2 | — | 0.45 | 0.5 | 0.05 |

COMPARATIVE EXAMPLE 1

An anode was manufactured from an anode rod of diameter 20 mm and total length 20 mm made of a cast alloy having the composition of sample A2 of Table 2. The anode rod was supported by a stem made of an alloy containing nickel, chromium and iron, such as Inconel, protected with an alumina sleeve. The anode was suspended for 16 hours over a molten cryolite-based electrolyte at 925° C. whereby its surface was oxidised.

Electrolysis was carried out by fully immersing the anode rod in the molten electrolyte. The electrolyte contained 18 weight % aluminium fluoride ($AlF_3$), 6.5 weight % alumina ($Al_2O_3$) and 4 weight % calcium fluoride ($CaF_2$), the balance being cryolite ($Na_3AlF_6$).

The current density was about 0.8 A/cm$^2$ and the cell voltage was at 3.5-3.8 volt throughout the test. The concentration of dissolved alumina in the electrolyte was maintained during the entire electrolysis by periodically feeding fresh alumina into the cell.

After 50 hours electrolysis was interrupted and the anode extracted. Upon cooling the anode was examined externally and in cross-section.

The anode's outer dimensions had remained substantially unchanged. The anode's oxide outer part had grown from an initial thickness of about 70 micron to a thickness after use of about up to 500 micron.

Samples of the used electrolyte and the product aluminium were also analysed. It was found that the electrolyte contained 150-280 ppm nickel and the product aluminium contained roughly 1000 ppm nickel.

COMPARATIVE EXAMPLE 2

Another comparative aluminium electrowinning anode was prepared according to the invention as follows:

A slurry for coating an anode substrate was prepared by suspending in 32.5 g of an aqueous solution containing 5 weight % polyvinyl alcohol (PVA) 67.5 g of a nitride/carbide-free particle mixture made of 86 weight % $Fe_2O_3$ particles, 10 weight % $TiO_2$ particles and 2 weight % CuO particles (with particle sizes of −325 mesh, i.e. smaller than 44 micron).

An anode substrate made of the alloy of sample A2 of Table 2 was covered with six layers of this slurry that were applied with a brush. The applied layers were dried for 10 hours at 140° C. in air and then consolidated at 950° C. for 16 hours to form a hematite-based coating which had a thickness of 0.24 to 0.26 mm.

During consolidation, the $Fe_2O_3$ particles were sintered together into a matrix with a volume contraction. Pores formed by this contraction had agglomerated to form small cracks that had a length of the order of 1.5.mm and a width of up to 20 micron. The $TiO_2$ particles and CuO particles were dissolved in the sintered $Fe_2O_3$.

EXAMPLE 1

An aluminium electrowinning anode was prepared according to the invention as follows:

A slurry for coating an anode substrate was prepared by suspending in 32.5 g of an aqueous solution containing 5 weight % polyvinyl alcohol (PVA) 67.5 g of a particle mixture made of hematite $Fe_2O_3$ particles, boron nitride particles, $TiO_2$ particles and CuO particles (with particle size of −325 mesh, i.e. smaller than 44 micron) in a weight ratio corresponding to sample Al of Table 1.

An anode substrate made of the alloy of sample A2 of Table 2 was covered with ten layers of this slurry that were applied with a brush. The applied layers were dried for 10 hours at 140° C. in air and then consolidated at 950° C. for 16 hours to form a protective hematite-based coating which had a thickness of 0.4 to 0.45 mm.

During consolidation, the $Fe_2O_3$ particles were sintered together into a microporous matrix with a volume contraction. The $TiO_2$ particles and CuO particles were dissolved in the sintered $Fe_2O_3$. The boron nitride particles remained substantially inert during the sintering but prevented migration and agglomeration of the micropores into cracks. Hence, as opposed to Comparative Example 2, the hematite-containing protective layer was crack-free even though it was thicker, and thus this boron nitride-containing hematite layer was able better to inhibit diffusion from and to the metal-based substrate.

Underneath the coating, an integral oxide scale mainly of iron oxide had grown from the substrate during the heat treatment and sintered with iron oxide and titanium oxide from the coating to firmly anchor the coating to the substrate. The sintered integral oxide scale contained titanium oxide in an amount of about 10 metal weight %. Minor amounts of copper, aluminium and nickel were also found in the oxide scale (less that 5 metal weight % in total).

EXAMPLE 2

An anode was prepared as in Example 1 by covering an iron-alloy substrate with layers of a slurry containing a particle mixture of $Fe_2O_3$, BN, $TiO_2$ and CuO.

The applied layers were dried and then consolidated by suspending the anode for 16 hours over a cryolite-based electrolyte at about 925° C. The electrolyte contained 18 weight % aluminium fluoride ($AlF_3$), 6.5 weight % alumina ($Al_2O_3$) and 4 weight % calcium fluoride ($CaF_2$), the balance being cryolite ($Na_3AlF_6$).

Upon consolidation of the layers, the anode was immersed in the molten electrolyte and an electrolysis current was passed from the anode to a facing cathode through the alumina-containing electrolyte to evolve oxygen anodically and produce aluminium cathodically. A high oxygen evolution was observed during the test. The current density was about 0.8 A/cm$^2$ and the cell voltage was stable at 3.1-3.2 volt throughout the test.

Compared to an uncoated anode, i.e. the anode of comparative Example 1, the coating of an alloy-anode with an oxide protective layer according to the invention led to an improvement of the anode performance such that the cell voltage was stabilised and also reduced by 0.4 to 0.6 volt, which corresponds to about 10 to 20%, thus permitting tremendous energy savings.

After 50 hours, the anode was extracted from the electrolyte and underwent cross-sectional examination.

The dimension of the coating had remained substantially unchanged. However, $TiO_2$ had selectively been dissolved in the electrolyte from the protective coating. The integral oxide layer of the anode substrate had grown to a thickness of 200 micron, i.e. at a much slower rate than the oxide layer of the uncoated anode of Comparative Example 1.

Samples of the used electrolyte and the product aluminium were also analysed. It was found that the electrolyte contained less that 70 ppm nickel and the produced aluminium contained less than 300 ppm nickel which is significantly lower than with the uncoated anode of Comparative Example 1. This demonstrated that the protective coating of the invention constituted an efficient barrier reducing nickel dissolution from the anode's alloy, inhibiting contamination of the product aluminium by nickel.

EXAMPLE 3

Examples 1 and 2 can be repeated using different combinations of coating compositions (A1-Q1) selected from Table 1 and metal alloy compositions (A2-O2) selected from Table 2.

While the invention has been described in conjunction with specific embodiments thereof, it is evident that alternatives, modifications, and variations will be apparent to those skilled in the art.

For example, in a modification of the invention, all the materials described above for forming the hematite-containing protective layers can alternatively be shaped into a body and sintered to form a massive component, in particular an aluminium electrowinning anode, made of the hematite-containing material. Such a component can be made of oxides or, especially when used as a current carrying component, of a cermet having a metal phase for improving the electrical conductivity of the material.

The invention claimed is:

1. A method of forming a hematite-containing protective layer on a metal-based substrate for use in a high temperature oxidising and/or corrosive environment, said method comprising:

applying onto the substrate a particle mixture consisting of:

(a) 60 to 99 weight %, in particular 70 to 95 weight % such as 75 to 85 weight %, of: hematite ($Fe_2O_3$), or hematite and:

(1) iron metal (Fe) with a weight ratio $Fe/Fe_2O_3$ of preferably no more than 2, in particular in the range from 0.6 to 1.3;

(2) ferrous oxide (FeO) with a weight ratio $FeO/Fe_2O_3$ of preferably no more than 2.5, in particular in the range from 0.7 to 1.7; or (3) iron metal (Fe) and ferrous oxide (FeO), with weight ratios $Fe/Fe_2O_3$ and $FeO/Fe_2O_3$ that are in pro rata with the ratios of (1) and (2);

(b) 1 to 25 weight %, in particular 5 to 20 weight % such as 8 to 15 weight %, of nitride and/or carbide particles; and (c) 0 to 15 weight %, in particular 5 to 15 weight %, of one or more further constituents that consist of at least one metal or metal oxide or a heat-convertible precursor thereof;

and consolidating the hematite by heat treating the particle mixture to:

(1) oxidise iron metal (Fe) when present into ferrous oxide (FeO);

(2) sinter the hematite ($Fe_2O_3$) to form a porous sintered hematite matrix; and (3) oxidise the ferrous oxide (FeO), when present in the particle mixture as such and/or upon oxidation of said iron metal (Fe), into hematite ($Fe_2O_3$) so as to fill the sintered hematite matrix, and form the protective layer that is made of a microporous sintered hematite matrix in which the nitride and/or carbide particles are embedded and which contains, when present, said one or more further constituents.

2. The method of claim 1, wherein said nitride and/or carbide particles are selected from boron nitride, aluminium nitride, silicon nitride, silicon carbide, tungsten carbide and zirconium carbide, and mixtures thereof.

3. The method of claim 1, wherein said one or more further constituents are selected from oxides of titanium, yttrium, ytterbium, tantalum, manganese, zinc, zirconium, cerium and nickel and/or heat-convertible precursors thereof.

4. The method of claim 3, wherein the selected further constituent(s) of claim 3 is/are present in the protective layer in a total amount of 1 to 15 weight %, preferably 5 to 12 weight %.

5. The method of claim 1, wherein said one or more further constituents are selected from metallic Cu, Ag, Pd, Pt, Co, Cr, Al, Ga, Ge, Hf, In, Ir, Mo, Mn, Nb, Re, Rh, Ru, Se, Si, Sn, Ti, V, W, Li, Ca, Ce and Nb and oxides thereof, and/or heat-convertible precursors thereof.

6. The method of claim 5, wherein the selected further constituent(s) of claim 5, in particular copper and/or copper oxide, is/are present in a total amount of 0.5 to 15 weight %, preferably from 0.5 to 5 weight, in particular from 1 to 3 weight %.

7. The method of claim 1, wherein the particle mixture is made of particles that are smaller than 75 micron, preferably smaller than 50 micron, in particular from 5 to 45 micron.

8. The method of any preceding claim 1, wherein the substrate is metallic, a ceramic, a cermet or metallic with an integral oxide layer.

9. The method of claim 1, wherein the substrate comprises at least one metal selected from chromium, cobalt, hafnium, iron, molybdenum, nickel, copper, niobium, platinum, silicon, tantalum, titanium, tungsten, vanadium, yttrium and zirconium.

10. The method of claim 9, wherein the substrate comprises an alloy of iron, in particular an iron-nickel alloy optionally containing at least one further element selected from cobalt, copper, aluminium, yttrium, manganese, silicon and carbon.

11. The method of claim 1, comprising oxidising the surface of a metallic substrate to form an integral anchorage layer thereon to which the protective layer is bonded by sintering during heat treatment, in particular an integral layer containing an oxide of iron and/or another metal, such as nickel, that is sintered during heat treatment with iron oxide from the particle mixture.

12. The method of claim 1, wherein the particle mixture is applied in a slurry onto the substrate.

13. The method of claim 12, wherein the slurry comprises an organic binder, in particular a binder selected from polyvinyl alcohol, polyvinyl acetate, polyacrylic acid, hydroxy propyl methyl cellulose, polyethylene glycol, ethylene glycol, hexanol, butyl benzyl phthalate and ammonium polymethacrylate.

14. The method of claim 12, wherein the slurry comprises an inorganic binder, in particular a colloid, such as a colloid selected from lithia, beryllium oxide, magnesia, alumina, silica, titania, vanadium oxide, chromium oxide, manganese oxide, iron oxide, gallium oxide, yttria, zirconia, niobium oxide, molybdenum oxide, ruthenia, indium oxide, tin oxide, tantalum oxide, tungsten oxide, thallium oxide, ceria, hafnia and thoria, and precursors thereof such as hydroxides, nitrates, acetates and formates thereof, all in the form of colloids; and/or an inorganic polymer, such as a polymer selected from lithia, beryllium oxide, alumina, silica, titania, chromium oxide, iron oxide, nickel oxide, gallium oxide, zirconia, niobium oxide, ruthenia, indium oxide, tin oxide, hafnia, tantalum oxide, ceria and thoria, and precursors thereof such as hydroxides, nitrates, acetates and formates thereof, all in the form of inorganic polymers.

15. The method of claim 14, wherein the inorganic binder is sintered during the heat treatment with an oxide of an anchorage layer which is integral with the substrate to bind the protective layer to the substrate.

16. The method of claim 1, wherein the particle mixture is consolidated on the substrate by heat treatment at a temperature in the range from 800° to 1400° C., in particular from 850° to 1150° C.

17. The method of claim 1, wherein the particle mixture is consolidated on the substrate by heat treatment for 1 to 48 hours, in particular for 5 to 24 hours.

18. The method of claim 1, wherein the particle mixture is consolidated on the substrate by heat treatment in an atmosphere containing 10 to 100 mol % $O_2$.

19. The method of any preceding claim for manufacturing a component of a metal electrowinning cell, in particular an aluminium electrowinning cell, which during use is exposed to molten electrolyte and/or cell fumes and protected therefrom by said protective layer.

20. The method of claim 19 for manufacturing a current carrying anodic component, in particular an active anode structure or an anode stem.

21. A method of electrowinning a metal, such as aluminium, comprising manufacturing a current-carrying anodic component protected by said protective layer as defined in claim 20, installing the anodic component in a molten electrolyte containing a dissolved salt of the metal to electrowin such as alumina, and passing an electrolysis current from the anodic component to a facing cathode in the molten electrolyte to evolve oxygen anodically and produce the metal cathodically.

22. The method of claim 21, wherein the electrolyte is a fluoride-based molten electrolyte, in particular containing fluorides of aluminium and sodium.

23. The method of claim 21, comprising maintaining the electrolyte at a temperature in the range from 800° to 960° C., in particular from 880° to 940° C.

24. The method of claim 21, comprising maintaining in the electrolyte, particularly adjacent the anodic component, an alumina concentration which is at or close to saturation.

25. The method claim 21, comprising maintaining an amount of iron species in the electrolyte to inhibit dissolution of the protective layer of the anodic component.

26. The method of claim 19 for manufacturing a cover.

27. The method of claim 19, comprising consolidating the particle mixture to form the protective layer by heat treating the cell component over the cell.

28. A hematite-containing protective layer on a metal-based substrate for use in a high temperature oxidising and/or corrosive environment, producible by the method of claim 1, which is microporous and at least substantially crack-free and contains nitride and/or carbide particles.

29. A cell for the electrowinning of a metal, such as aluminium, having at least one component that comprises a metal-based substrate covered with a hematite-containing protective layer as defined in claim 28.

30. A method of electrowinning a metal, such as aluminium, comprising manufacturing a cover protected by said protective layer as defined in claim 26, placing the cover over a metal electrowinning cell trough containing a molten electrolyte in which a salt of the metal to electrowin is dissolved, passing an electrolysis current in the molten electrolyte to evolve oxygen anodically and the metal cathodically, and confining electrolyte vapours and evolved oxygen within the cell trough by means of the protective layer of the cover.

31. A method of forming a hematite-containing body for use in a high temperature oxidising and/or corrosive environment, said method comprising:

providing a particle mixture consisting of:

(a) 60 to 99 weight %, in particular 70 to 95 weight % such as 75 to 85 weight %, of: hematite ($Fe_2O_3$), or hematite and:

(1) iron metal (Fe) with a weight ratio $Fe/Fe_2O_3$ of preferably no more than 2, in particular in the range from 0.6 to 1.3;

(2) ferrous oxide (FeO) with a weight ratio $FeO/Fe_2O_3$ of preferably no more than 2.5, in particular in the range from 0.7 to 1.7; or (3) iron metal (Fe) and ferrous oxide (FeO), with weight ratios $Fe/Fe_2O_3$ and $FeO/Fe_2O_3$ that are in pro rata with the ratios of (1) and (2);

(b) 1 to 25 weight %, in particular 5 to 20 weight % such as 8 to 15 weight %, of nitride and/or carbide particles; and (c) 0 to 15 weight %, in particular 5 to 15 weight %, of one or more further constituents that consist of at least one metal or metal oxide or a heat-convertible precursor thereof;

shaping the particle mixture into the body;

and consolidating the hematite by heat treating the particle mixture to:

(1) oxidise iron metal (Fe) when present into ferrous oxide (FeO);

(2) sinter the hematite ($Fe_2O_3$) to form a porous sintered hematite matrix; and (3) oxidise the ferrous oxide (FeO), when present in the particle mixture as such and/or upon oxidation of said iron metal (Fe), into hematite ($Fe_2O_3$) so as to fill the sintered hematite matrix, and form the hematite-containing body that is made of a microporous sintered hematite matrix in which the nitride and/or carbide particles are embedded and which contains, when present, said one or more further constituents.

32. The method of claim 31 for manufacturing a component of a metal electrowinning cell, in particular, an aluminum electrowinning cell, which during use is exposed to molten electrolyte and/or cell fumes and protected therefrom by said protective layer.

* * * * *